US008985688B2

(12) United States Patent
Gorgi et al.

(10) Patent No.: US 8,985,688 B2
(45) Date of Patent: Mar. 24, 2015

(54) OFFICE CHAIR MECHANISM PROVIDED WITH A DEVICE FOR ADJUSTING THE SWIVEL FORCE

(75) Inventors: Claudio Gorgi, Rossano Veneto (IT); Andrea Francesco Zanchetta, Bassano del Grappa (IT)

(73) Assignee: Imarc S.p.A., Rossano Veneto (VI) (IT)

( * ) Notice: Subject to any disclaimer, the term of this patent is extended or adjusted under 35 U.S.C. 154(b) by 23 days.

(21) Appl. No.: 13/879,970

(22) PCT Filed: Nov. 30, 2011

(86) PCT No.: PCT/EP2011/071373

§ 371 (c)(1), (2), (4) Date: Apr. 18, 2013

(87) PCT Pub. No.: WO2012/072675

PCT Pub. Date: Jun. 7, 2012

(65) Prior Publication Data

US 2013/0234485 A1 Sep. 12, 2013

(30) Foreign Application Priority Data

Dec. 3, 2010 (IT) ..... VE2010A0062

(51) Int. Cl.
*A47C 1/024* (2006.01)
*A47C 1/032* (2006.01)

(52) U.S. Cl.
CPC ..... *A47C 1/03283* (2013.01); *A47C 1/03238* (2013.01); *A47C 1/03255* (2013.01); *A47C 1/03266* (2013.01); *A47C 1/03272* (2013.01); *A47C 1/03294* (2013.01)
USPC ..... 297/303.2

(58) Field of Classification Search
CPC ..... A47C 1/0325; A47C 1/03266; A47C 1/03261; A47C 1/03255; A47C 1/03294
USPC ..... 297/303.2, 303.1, 300.2, 300.1, 285, 297/293, 297, 300.4
See application file for complete search history.

(56) References Cited

U.S. PATENT DOCUMENTS

| | | | | | |
|---|---|---|---|---|---|
| 3,740,792 | A | * | 6/1973 | Werner | 16/298 |
| 4,629,249 | A | * | 12/1986 | Yamaguchi | 297/300.3 |
| 4,641,885 | A | * | 2/1987 | Brauning | 297/303.1 |
| 5,348,371 | A | * | 9/1994 | Miotto | 297/303.2 |
| 5,564,783 | A | * | 10/1996 | Elzenbeck et al. | 297/300.2 |
| 5,584,533 | A | * | 12/1996 | Schrewe | 297/300.2 |
| 5,601,337 | A | * | 2/1997 | Choda et al. | 297/302.1 |

(Continued)

FOREIGN PATENT DOCUMENTS

| | | |
|---|---|---|
| EP | 1358821 | 11/2003 |
| EP | 1911371 | 4/2008 |
| WO | 2006114250 | 11/2006 |

*Primary Examiner* — Jose V Chen
(74) *Attorney, Agent, or Firm* — Themis Law

(57) ABSTRACT

An office chair mechanism provided with a device for adjusting the swivel force includes a fixed part secured to the chair base, movable parts secured to the seating portion and to the back rest (22) of the chair, and an elastic element which opposes the weight of the chair user, a lever having contact surfaces which interact with said fixed part by means of a fulcrum having a movable contact element interposed between the end acting on the elastic element and the other end to which the movable parts are pivoted, and an adjustment element which causes only the movable contact element to move but without modifying the position of the elastic element and of the lever.

10 Claims, 6 Drawing Sheets

(56) References Cited

U.S. PATENT DOCUMENTS

| | | | | |
|---|---|---|---|---|
| 5,873,634 | A * | 2/1999 | Heidmann et al. | 297/440.14 |
| 6,139,103 | A * | 10/2000 | Hybarger et al. | 297/300.5 |
| 6,213,552 | B1 * | 4/2001 | Miotto | 297/300.5 |
| 6,431,649 | B1 * | 8/2002 | Hensel | 297/300.2 |
| 6,523,897 | B2 * | 2/2003 | Pan | 297/302.1 |
| 6,779,847 | B2 * | 8/2004 | Klein | 297/301.2 |
| 6,840,578 | B1 * | 1/2005 | Su | 297/302.3 |
| 6,874,853 | B2 * | 4/2005 | Wild | 297/300.2 |
| 6,886,888 | B2 * | 5/2005 | Bock | 297/300.2 |
| 7,429,081 | B2 * | 9/2008 | Roslund et al. | 297/300.2 |
| 7,566,097 | B2 * | 7/2009 | Sander et al. | 297/300.2 |
| 7,850,237 | B2 * | 12/2010 | Gorgi | 297/303.1 |
| 8,100,477 | B2 * | 1/2012 | Fich | 297/303.5 |
| 8,297,701 | B2 * | 10/2012 | Machael et al. | 297/303.1 |
| 2011/0062759 | A1 * | 3/2011 | Hartel | 297/300.2 |
| 2012/0161482 | A1 * | 6/2012 | Hayashi | 297/300.1 |

* cited by examiner

OFFICE CHAIR MECHANISM PROVIDED WITH A DEVICE FOR ADJUSTING THE SWIVEL FORCE

FIELD OF THE INVENTION

The present invention relates to an office chair mechanism provided with a device for adjusting the swivel force.

BACKGROUND OF THE INVENTION

To modify the swivel force for the different body weights and preferences of different office chair users, various mechanism adjustment devices have already been proposed, however these mostly act on the preloading of springs.

If compression springs are used, an adjustment knob coaxial to the spring is operated. However, if torsion springs are used, the preload is varied by using elements which pull or push the free end of the spring.

The main drawback of this system is the fact that the preload adjustment cannot be too large otherwise insurmountable problems are introduced relating to spring reliability and chair design compactness. In addition to overcome the spring force during adjustment, an always critical compromise has to be reached between the physical force and the down-gearing (large number of screw turns) required for the adjustment. However the main drawback from the ergonomic viewpoint is that because the force increase during swiveling is always constant and if a "light" user encounters excessive hardness during swiveling, this for a "heavy" user could possibly be insufficient.

To obviate these drawbacks various solutions have already been proposed, such as those described in EP 1874161 or in U.S. Pat. No. 6,238,000, but these are costly and bulky.

SUMMARY OF THE INVENTION

An object of the invention is to eliminate these drawbacks by providing an adjustment device which while being compact, sufficiently economical and of simple and very wide adjustment, is also ergonomically suitable for both very light and very heavy users.

This and other objects which will be apparent from the ensuing description are attained according to the invention by an office chair mechanism as described in hereinafter.

BRIEF DESCRIPTION OF THE DRAWINGS

The present invention is further clarified hereinafter with reference to the accompanying drawing, in which.

DETAILED DESCRIPTION OF EMBODIMENTS OF THE INVENTION

Figure 1:
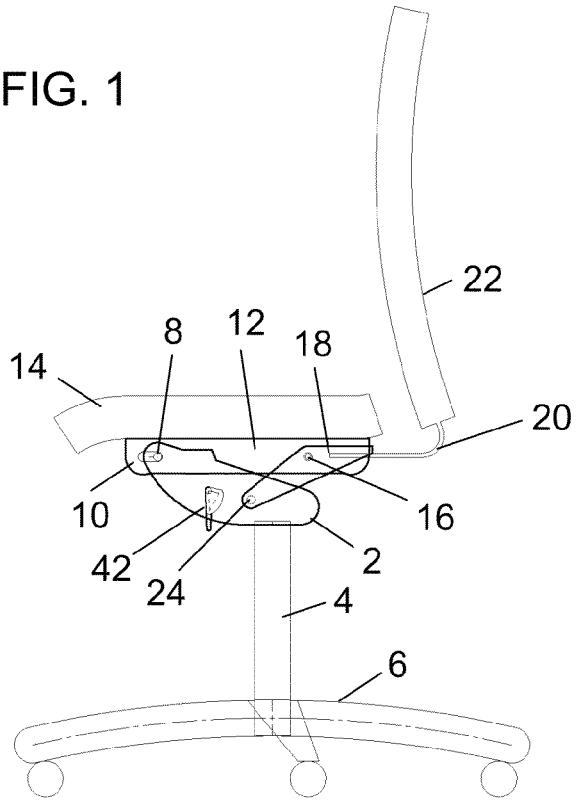
FIG. 1 is a lateral schematic view of a chair provided with the device of the invention in its non-stressed condition.
Figure 2:
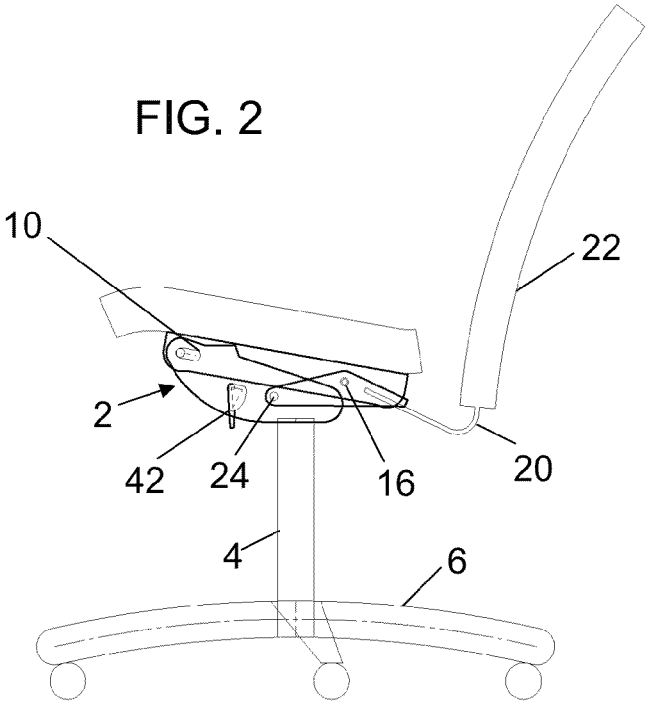
FIG. 2 shows it in the same view as FIG. 1 but in the stressed condition.
Figure 3:
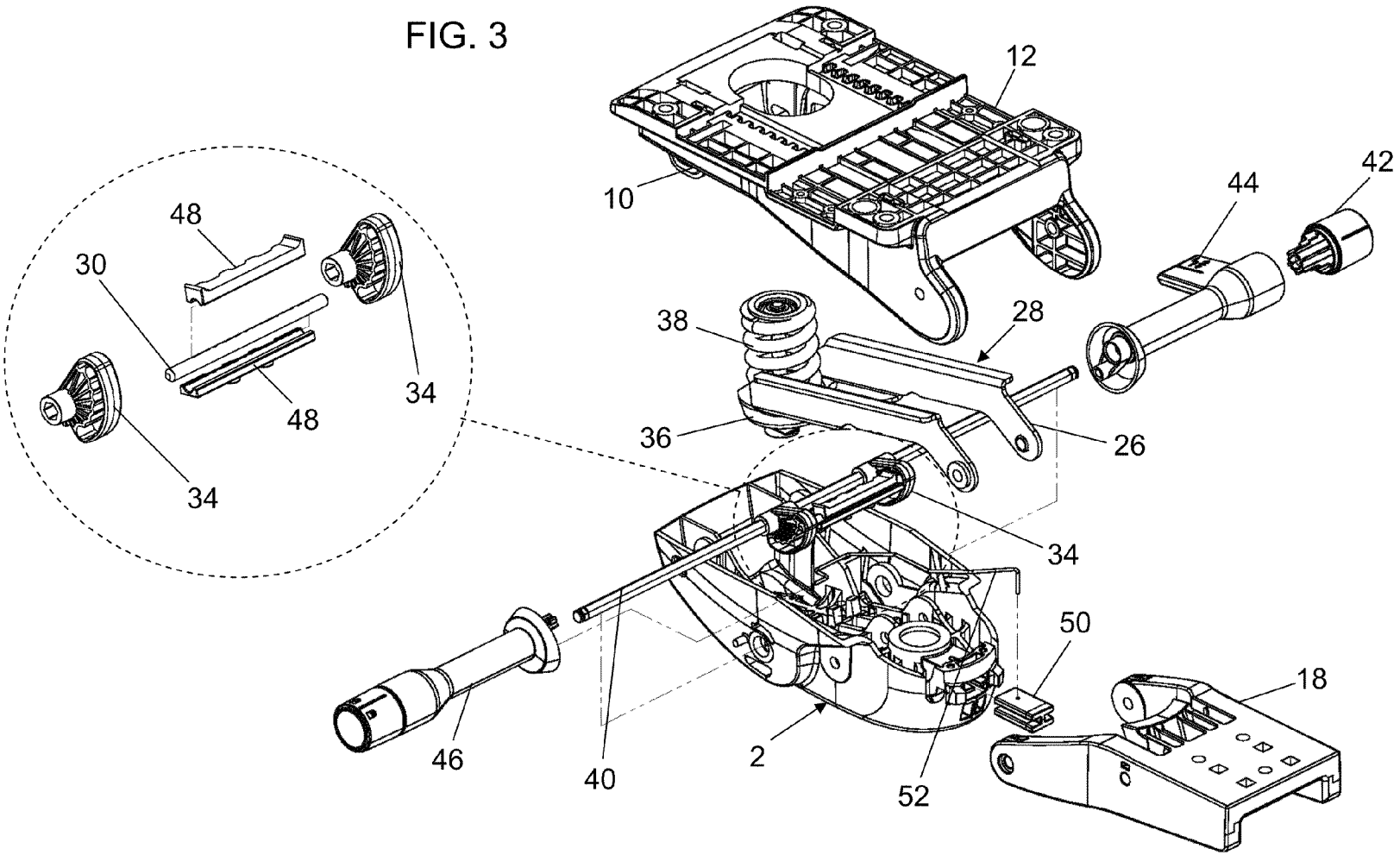
FIG. 3 is an exploded perspective view of the device of the invention showing the adjustment system in detail.

As can be seen from the figures, the adjustment device according to the invention is applied to an office chair mechanism consisting of a fixed box structure 2 provided lowerly with a frusto-conical bush for inserting the upper end of the shaft 4 of a traditional gas spring (not represented in the drawings), the function of which is to sustain the support as it swivels relative to a resting base 6.

The fixed box structure 2 is hinged about a pin 8 slidable within a horizontal slotted hole 10 provided in a support plate 12 for the chair seating portion 14.

A bar 18 rigid with a support arm 20 for the back rest 22 is pivoted about a pin 16 on the plate 12.

The beam is finally pivoted to the box structure 2 about a pin 24.

About the same pin 16 there is pivoted one end 26 of a lever shaped bar 28 with its fulcrum on a contact element 30, in the illustrated example a pin, selectively positionable along two resting surfaces 32, 32' provided on the box structure 2 and on the lever 28.

Figure 8:
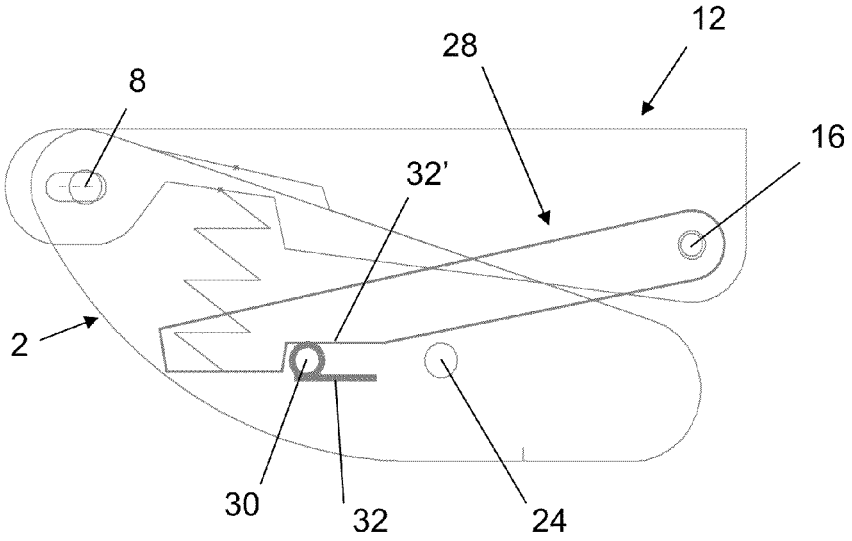
FIGS. 8 and 9 are schematic views of two different embodiments of the device of the invention.
Figure 9:
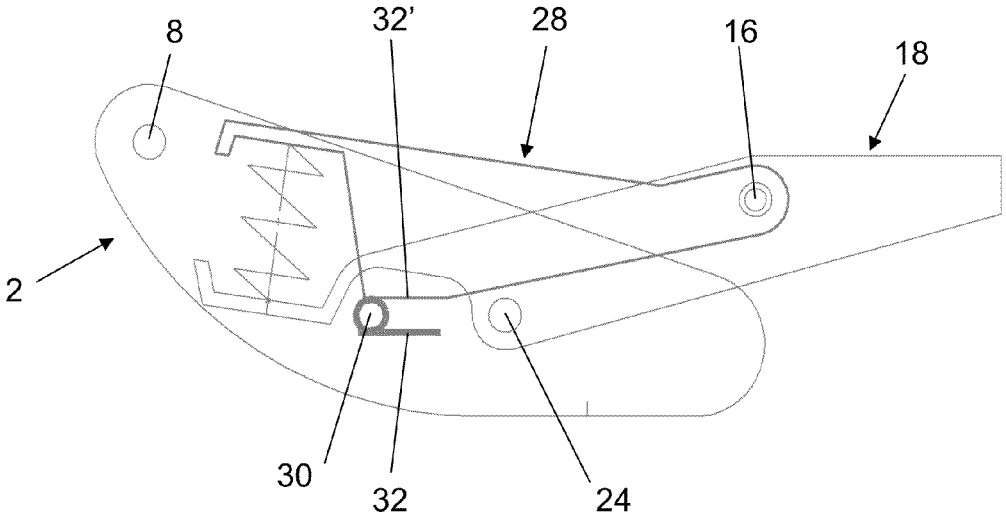
Figure 10:
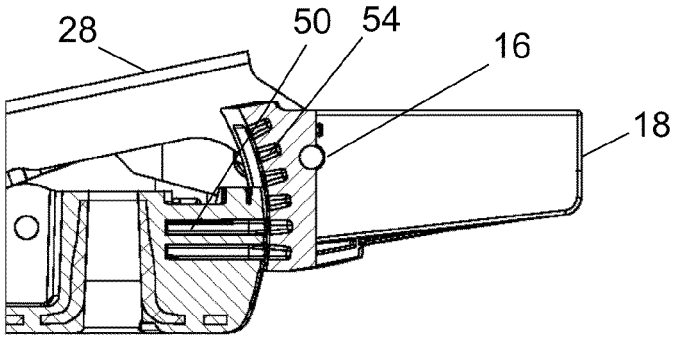
FIGS. 10, 11 and 12 show a detail of the device of the invention for locking chair swiveling.
Figure 11:
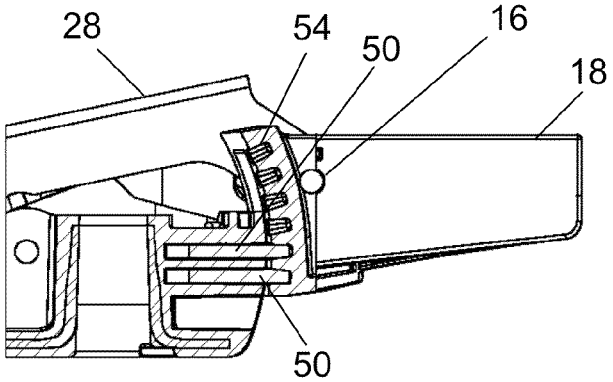
Figure 12:
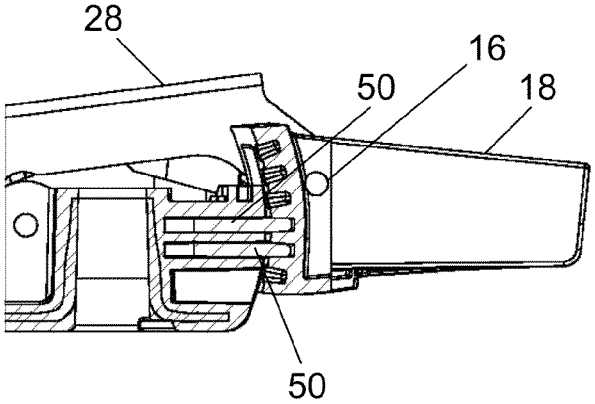

The other end 36 of the lever 28 acts on a helical spring 38 which acts against the surface of the box structure (see FIGS. 4-7) or against the chair support plate 12 (see FIG. 8) or against the support bar 18 for the back rest 22 (see FIG. 9).

The adjustment of the position of the contact element 30 takes place along said parallel resting surfaces 32, 32', by which any other movement of the helical spring 38 and of the lever 28 is avoided. The element which undergoes movement is not subjected to compression when the surfaces are parallel, i.e. when the chair is in the rest position, whereas it becomes the fulcrum of the lever 28 during swiveling. The elements involved in the adjustment are therefore reduced to a minimum. This characteristic therefore enables easy and quick adjustment while using reliable low-cost components, for example by using a simple cam device 34 which moves the contact element (pin) 30.

The lever has a shape such that the contact element 30, following its adjustment movement, maximizes the difference between the two lever arms.

This is obtained preferably by positioning the three points:

36 (spring resting end/lever)

30 contact element

16 articulation axis lever/movable parts by aligning them along a single axis preferably perpendicular to the direction of the forces and by moving the contact element along said axis.

The cam device is mounted on a single control rod 40 which is provided at one end with a knob 42 for rotating the cam 34 and with a knob 44 for operating a gas spring, and at the other end with a knob 46 for locking the rotation of the back rest.

To facilitate sliding of the element 30 which forms the lever fulcrum along the surfaces 32, 32', slide shoes 48 of self-lubricating plastic material are provided (wrapped about the pin).

In the rear part of the box structure a catch is provided formed from two plates 50 operable axially by an elastic puller 52 connected to the knob 46 controlling the locking operation.

The plates 50 are selectively insertable into two of a plurality of facing seats 54 (six in the illustrated example) provided in the bar 18 such as to lock its rotation and hence lock the chair.

The operating principle of the device of the invention is as follows.

Figure 4:
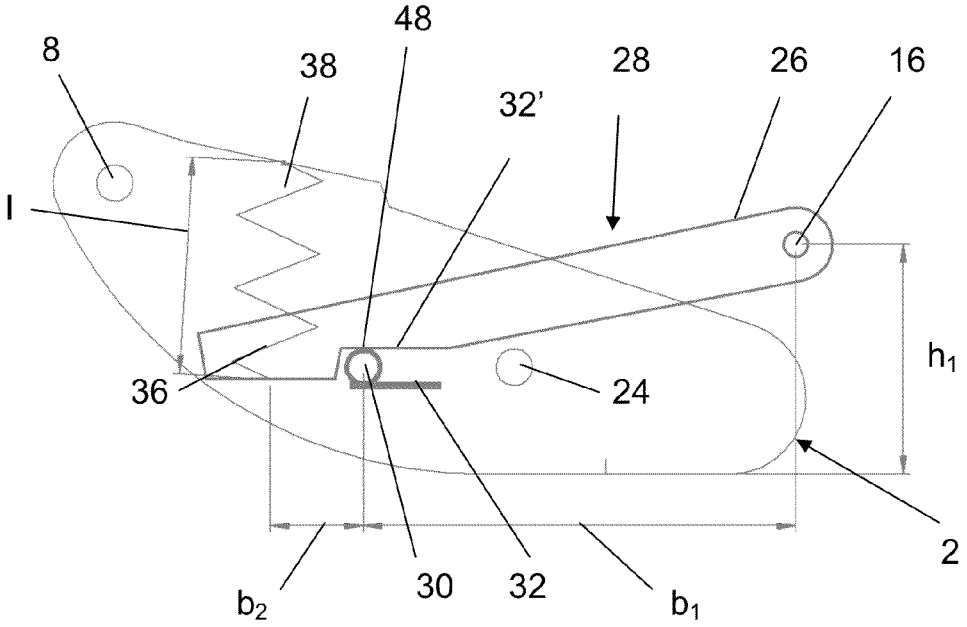
FIGS. 4 and 5 are schematic views of the device of the invention shown respectively in the chair empty and chair stressed configuration.
Figure 5:
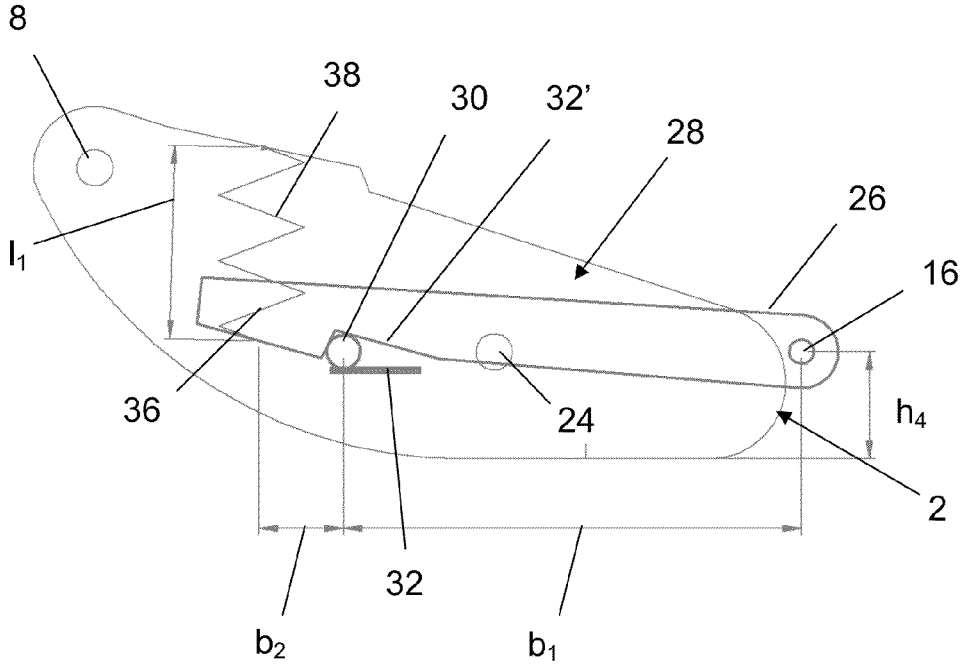

FIGS. 4 and 5 show the spring compression as the chair passes from a configuration in which the chair is not stressed to a configuration in which a user is seated on the chair and has inclined the back rest rearwards to hence stress the spring.

Operating the knob 42 of the force adjustment device causes the contact element 30 to move, this constituting the fulcrum of a first order lever 28 having the elastic means 38 at one end 36 and, at the other end 26, the pin 16 with one of the movable parts 18 of the geometry of which the mechanism is composed. By shifting the position of this fulcrum relative to the power and resistance points positioned at the two ends 26, 36 of the lever, the lever effect can be adjusted by inversely varying the length of the arm of the spring relative to that of the arm connected to the movable part 16.

Figure 6:
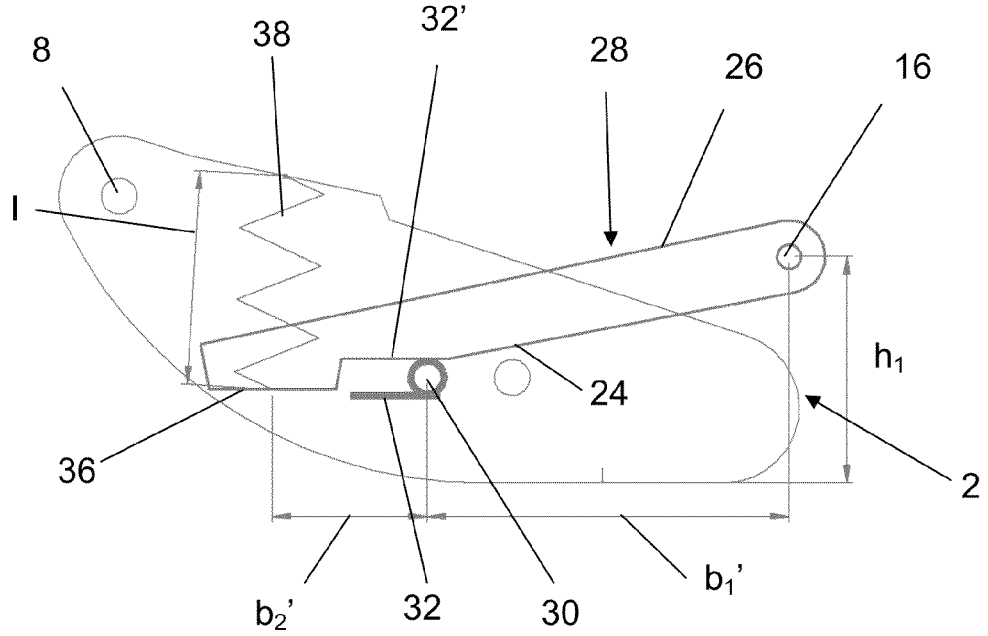
FIGS. 6 and 7 show the device in the same views as FIGS. 4 and 5 but with the fulcrum in a different position.
Figure 7:
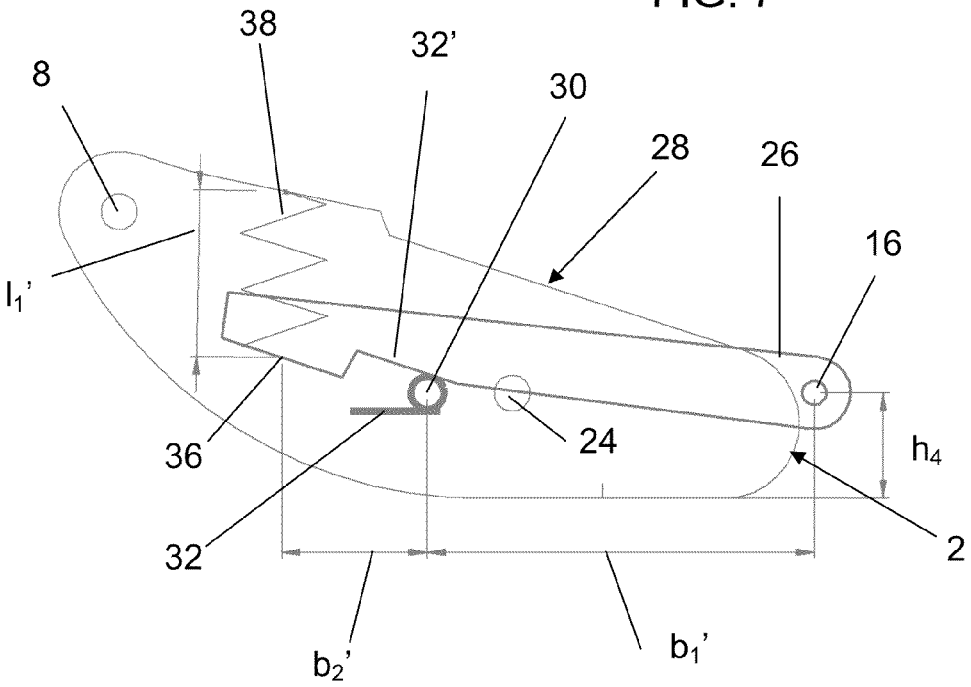

FIGS. 6 and 7 show the chair in the same configurations as in FIGS. 4 and 5, but with the fulcrum 30 shifted along the surfaces 32, 32' in the sense of causing it to approach the axis of the pivot pin 16.

From a comparison of these figures it is clear that the spring 38, for the same back rest inclination ($h_1$-$h_4$), is more greatly compressed in the configuration shown in FIG. 7 than in the configuration shown in FIG. 5, so that it offers greater swivel resistance.

Again comparing FIGS. 5 and 7, as the lever 28 is in equilibrium on the fulcrum 30, the moment of rotation R due to the reaction of the pin 16 about the fulcrum 30 is equal to the moment of rotation due to the thrust P of the spring about the same fulcrum 30.

Hence in FIG. 5:

$$Rb_1=Pb_2$$

from which $$R=Pb_2/b_1$$

Then on shifting the fulcrum, in FIG. 7 we have $$R'=Pb_2'\cdot b_1'$$

Now as $$b_2'>b_2$$

and $$b_1'<b_1,$$

then $$R'>>R$$

with values of R' double or even triple the values of R.

In this manner, although using the same spring, persons of 40 kg and persons of 120 kg can both be supported by shifting the fulcrum 30.

From the aforegoing it is apparent that the device of the invention presents numerous advantages, and in particular:

chair versatility in that a mechanism is obtained with very wide force adjustment, very valid ergonomics in that the adjustment control is easy and rapid, less constructional complexity than similar devices and hence lesser costs, a compact mechanism design enabling the chair appearance to be improved.

What is claimed is:

1. An office chair mechanism provided with a device for adjusting swivel force of a chair, comprising:

a fixed part secured to a chair base;

movable parts secured to a seating portion and to a back rest of the chair, and a biasing element which opposes a weight of a chair user;

a lever acting by a first end thereof on said biasing element and pivoted at a second end thereof to one of said movable parts, said lever interacting also with said fixed part through a contact element movable between the first end of the lever and the second end, said contact element operating as a fulcrum of said lever, said biasing element having an end into touch with one of the fixed parts or movable parts; and an adjustment element which causes only the contact element to move without modifying a position of the biasing element and of the lever, wherein said contact element is movable by causing said adjustment element to slide said contact element between parallel surfaces respectively provided on said fixed part and on said lever, thereby avoiding a change in the position of the biasing element.

2. The office chair mechanism as claimed in claim 1, wherein the biasing element is interposed between the first end of the lever and the fixed part.

3. The office chair mechanism as claimed in claim 1, wherein the biasing element is interposed between the first end of the lever and a movable part rigid with a movement of the seating portion.

4. The office chair mechanism as claimed in claim 1, wherein the biasing element is interposed between the first end of the lever and a movable part rigid with a movement of the back rest.

5. The office chair mechanism as claimed in claim 1, wherein the adjustment element comprises a cam.

6. The office chair mechanism as claimed in claim 5, further comprising at least one catch projecting from a rear side of the fixed part and selectively engaging one of a plurality of holes provided in a support bar of the back rest, wherein the cam is operated by a rod on which a gas spring adjustment knob and a catch operating knob are also mounted.

7. The office chair mechanism as claimed in claim 1, further comprising at least one catch projecting from a rear side of the fixed part and selectively engaging one of a plurality of holes provided in a support bar of the back rest.

8. The office chair mechanism as claimed in claim 7, wherein the catch comprises two or more plates.

9. The office chair mechanism as claimed in claim 1, wherein the fulcrum is wrapped by slide shoes of self-lubricating plastic material.

10. The office chair mechanism as claimed in claim 1, wherein the lever has a substantially rectilinear shape.

* * * * *